PLYWOOD DRIVING TOOL

BACKGROUND OF THE INVENTION

1. Field of the Invention

This invention relates to tools and more particularly to a driving tool for use in driving tongue and groove plywood sheets into seated configuration.

2. Prior Art

Tongue and groove mating wood products have been in common use for centuries. Such construction is particularly well-known in flooring and subflooring where the longitudinal side edges of two boards which are to be placed side by side for the flooring or subflooring are respectively tongued and grooved. Tongue and grooving not only provides a relatively secure method of maintaining two adjacent boards together and coplaner, it has the distinct advantage of assisting in reducing bulging.

However, tongue and groove jont connections can be difficult to make, particularly where the tongue is designed to mate snuggly in the groove. This difficulty in seating the tongue in the groove is substantially increased due to the natural tendency of elongated boards to warp. Where slat flooring is used, warp connection and the tongue and groove seating can be accomplished simultaneously with the nailing of the slat to the subfloor. However, where large plywood boards are used either for the subfloor or, as is common in some residential construction, for the entire floor, the width of the plywood sheet or panel increases the difficulty of properly seating the tongue and groove connection.

A standard method of laying such plywood flooring or subflooring involves the use of both bonding glue and nailing. However the glue must be applied to the underside of the plywood or to the supporting joists prior to the seating of the tongue and groove joint. Thereafter it is desirable to properly seat the tongue and groove joint as quickly as possible and to secure the connection by nailing or screwing. Because the plywood board may be quite long, dimensions on the order of 8 feet being common, and because of normal edge warpage, significant increments of force must be used to properly seat the tongue and groove connection.

A common method of seating plywood boards involves the use of a heavy mallet or sledgehammer which is forcibly applied against the free edge of the board. Since significant force is often required, in order to protect the free edge, a protective member is generally placed between the sledge and the plywood edge. In standard practice, 2×4 boards are commonly used.

Because it is desired to seat the entire tongue and groove connection substantially simultaneously, the protective 2×4 board which is used is generally as long as the plywood board. Thus, where 8 foot plywood sheets are used, an 8 foot 2×4 is used as a buffer. Experience has indicated that such boards rarely last beyond the installation of flooring in more than a few rooms. Application of the sledge to the board crushes the wood and dents the board. At the same time the opposite side of the protective board is indented by contact with the edge of the plywood sheet. This practice results in a great waste of otherwise good structural lumber. While this waste could be substantially eliminated by utilizing a noncrushable protective member, such a rigid device would immediately transmit the entire force of the sledge blow directly through to the plywood sheet edge. This would result in localized damage to the plywood sheet edge. This damage is reduced, if not eliminated, when using the 2×4 boards due to the resiliency of the wood which both cushions the hammer or sledge blow while at the same time, spreading the force of that blow over a much wider area on the opposite side of the board.

It would therefore be an advance in the art to provide a device for seating tongue and groove plywood sheets to be used between the force applicator (sledgehammer) and the plywood sheet edge which would retain the resilient advantages of wood boards while eliminating the waste presently encountered.

SUMMARY OF THE INVENTION

It is a general object of this invention to provide a device having the above mentioned advance in the art. To this end, I provide a driving tool member to be used intermediate a force applicator such as a sledgehammer and the edge of a plywood flooring sheet which combines the resiliency of wood with the durability of steel.

In general, this invention provides a tool device for seating tongue and groove plywood sheets which has a central rectangular cross-section elongated wooden core with ledged or stepped side top and bottom corners. U-shaped cross-section metal members having spaced apart parallel legs interconnected by a flat bight extend along the side faces of the wood core with the legs of the metal members received in the ledges or steps of the corners of the core such that the outside surfaces of the legs are generally flush with the top and bottom of the core and the inside faces of the bight are in contact with the longitudinal sides of the core.

In a preferred embodiment, an outside face of one of the channel shaped metal members is faced with a resilient coating, preferably a vinyl.

In a further development of the preferred embodiment, the channel shaped metal members are retained on the wood core by adjustable fastening means which extend into the wood core both from the legs and through the bight. The adjustable fastening means may, if desired, extend entirely through the core or may, conversely, be members such as screws.

The use of a wood core provides for shock absorbency due to the resiliency of the wood while the metal facing on both longitudinal sides of the wood core provides for durability. The use of channel shaped metal facings substantially eliminates the tendency of the wood core to warp or bow. The provision of adjustable retaining means retaining the channel shaped metal members allows the contact between the metal member and to wood core to be adjusted to compensate for slight crushing or deformity of the wood core which can be encountered during prolonged use of the device. Further, adjustable fastening means allow the wood core to act in the shock absorbing manner without breaking the fastening between the metal channel members and the core.

Other objects, features and advantages of the invention will be readily apparent from the following description of preferred embodiments thereof, taken in conjunction with the accompanying drawings, although variations and modifications may be effected without departing from the spirit and scope of the novel concepts of the disclosure, and in which:

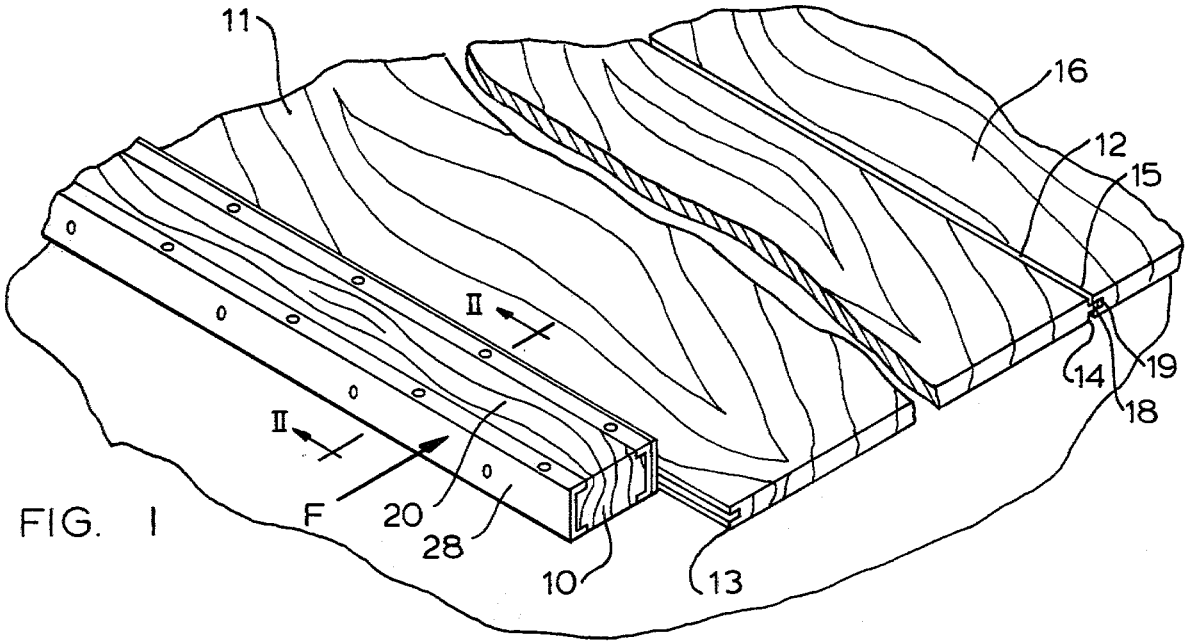
FIG. 1
FIG. 2
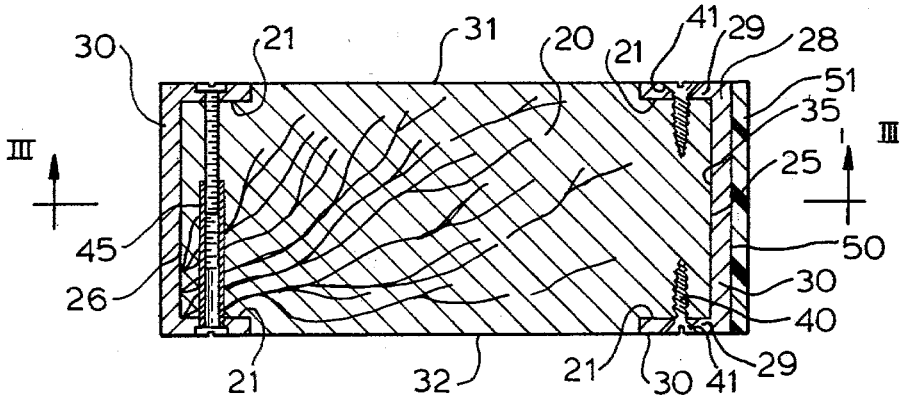
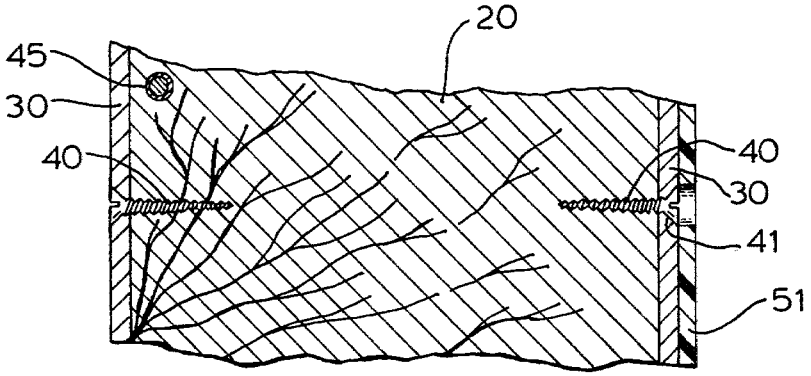
FIG. 3

PLYWOOD DRIVING TOOL

BACKGROUND OF THE INVENTION

1. Field of the Invention

This invention relates to tools and more particularly to a driving tool for use in driving tongue and groove plywood sheets into seated configuration.

2. Prior Art

Tongue and groove mating wood products have been in common use for centuries. Such construction is particularly well-known in flooring and subflooring where the longitudinal side edges of two boards which are to be placed side by side for the flooring or subflooring are respectively tongued and grooved. Tongue and grooving not only provides a relatively secure method of maintaining two adjacent boards together and coplaner, it has the distinct advantage of assisting in reducing bulging.

However, tongue and groove jont connections can be difficult to make, particularly where the tongue is designed to mate snuggly in the groove. This difficulty in seating the tongue in the groove is substantially increased due to the natural tendency of elongated boards to warp. Where slat flooring is used, warp connection and the tongue and groove seating can be accomplished simultaneously with the nailing of the slat to the subfloor. However, where large plywood boards are used either for the subfloor or, as is common in some residential construction, for the entire floor, the width of the plywood sheet or panel increases the difficulty of properly seating the tongue and groove connection.

A standard method of laying such plywood flooring or subflooring involves the use of both bonding glue and nailing. However the glue must be applied to the underside of the plywood or to the supporting joists prior to the seating of the tongue and groove joint. Thereafter it is desirable to properly seat the tongue and groove joint as quickly as possible and to secure the connection by nailing or screwing. Because the plywood board may be quite long, dimensions on the order of 8 feet being common, and because of normal edge warpage, significant increments of force must be used to properly seat the tongue and groove connection.

A common method of seating plywood boards involves the use of a heavy mallet or sledgehammer which is forcibly applied against the free edge of the board. Since significant force is often required, in order to protect the free edge, a protective member is generally placed between the sledge and the plywood edge. In standard practice, 2×4 boards are commonly used.

Because it is desired to seat the entire tongue and groove connection substantially simultaneously, the protective 2×4 board which is used is generally as long as the plywood board. Thus, where 8 foot plywood sheets are used, an 8 foot 2×4 is used as a buffer. Experience has indicated that such boards rarely last beyond the installation of flooring in more than a few rooms. Application of the sledge to the board crushes the wood and dents the board. At the same time the opposite side of the protective board is indented by contact with the edge of the plywood sheet. This practice results in a great waste of otherwise good structural lumber. While this waste could be substantially eliminated by utilizing a noncrushable protective member, such a rigid device would immediately transmit the entire force of the sledge blow directly through to the plywood sheet edge. This would result in localized damage to the plywood sheet edge. This damage is reduced, if not eliminated, when using the 2×4 boards due to the resiliency of the wood which both cushions the hammer or sledge blow while at the same time, spreading the force of that blow over a much wider area on the opposite side of the board.

It would therefore be an advance in the art to provide a device for seating tongue and groove plywood sheets to be used between the force applicator (sledgehammer) and the plywood sheet edge which would retain the resilient advantages of wood boards while eliminating the waste presently encountered.

SUMMARY OF THE INVENTION

It is a general object of this invention to provide a device having the above mentioned advance in the art. To this end, I provide a driving tool member to be used intermediate a force applicator such as a sledgehammer and the edge of a plywood flooring sheet which combines the resiliency of wood with the durability of steel.

In general, this invention provides a tool device for seating tongue and groove plywood sheets which has a central rectangular cross-section elongated wooden core with ledged or stepped side top and bottom corners. U-shaped cross-section metal members having spaced apart parallel legs interconnected by a flat bight extend along the side faces of the wood core with the legs of the metal members received in the ledges or steps of the corners of the core such that the outside surfaces of the legs are generally flush with the top and bottom of the core and the inside faces of the bight are in contact with the longitudinal sides of the core.

In a preferred embodiment, an outside face of one of the channel shaped metal members is faced with a resilient coating, preferably a vinyl.

In a further development of the preferred embodiment, the channel shaped metal members are retained on the wood core by adjustable fastening means which extend into the wood core both from the legs and through the bight. The adjustable fastening means may, if desired, extend entirely through the core or may, conversely, be members such as screws.

The use of a wood core provides for shock absorbency due to the resiliency of the wood while the metal facing on both longitudinal sides of the wood core provides for durability. The use of channel shaped metal facings substantially eliminates the tendency of the wood core to warp or bow. The provision of adjustable retaining means retaining the channel shaped metal members allows the contact between the metal member and to wood core to be adjusted to compensate for slight crushing or deformity of the wood core which can be encountered during prolonged use of the device. Further, adjustable fastening means allow the wood core to act in the shock absorbing manner without breaking the fastening between the metal channel members and the core.

Other objects, features and advantages of the invention will be readily apparent from the following description of preferred embodiments thereof, taken in conjunction with the accompanying drawings, although variations and modifications may be effected without departing from the spirit and scope of the novel concepts of the disclosure, and in which:

BRIEF DESCRIPTION OF THE DRAWINGS

FIG. 1 is a fragmentary perspective view of a device according to this invention being employed to seat tongue and groove plywood sheets.

FIG. 2 is a cross-sectional view of the device of FIG. 1 taken substantially along the lines II—II of FIG. 3.

FIG. 3 is a cross-sectional view of the device of FIG. 1 taken substantially normal to the cross-section view of FIG. 2 and along the lines III—III of FIG. 2.

DESCRIPTION OF THE PREFERRED EMBODIMENTS

As illustrated in FIG. 1, the device 10 of this invention consists of an elongated member having a width, height and length. The length of the member, as fragmentarily illustrated in FIG. 1, is considerably in excess of the width and height. In fact, the overall device has a width and height comparable to a 2×4 piece of lumber whereas the length is preferably in excess of 3 feet and can, in instances, be 8 feet so as to substantially coextensive with the side edge length of a sheet of plywood 11.

The device is used to seat plywood sheets along their tongue and groove joints 12. In use the device is applied to the free side edge 13 of a plywood sheet 11 to drive the opposed side edge 14 into seated engagement with the side edge 15 of the cooperating adjacent plywood sheet 16. As illustrated, preferably, the device 10 is applied against the groove side of the plywood sheet to force the tongue 18 into its mating groove 19.

As best illustrated in FIG. 2, the device 10 of this invention includes a wood core 20 of substantially rectangular cross-section which has stepped or ledged corners 21 extending along the length of the core. The core has a width which is sufficiently great as to provide the desired resiliency. It has been found, in practice, that a core constructed from a standard 2×4 is acceptable. The side faces 25 and 26 of the core are faced with metal members 28. The metal members 28 are preferably constructed of channel pieces of steel having spaced parallel leg portions 29 interconnected by a flat bight 30. The legs 29 are dimensioned with respect to the ledges or steps 21 to be received therein with the outside faces 30 of the legs 29 being substantially coplaner with the top 31 and bottom 32 faces of the core beyond the ledges or steps 21. Preferably the inside opposed faces of the legs 29 contact the wood core at the bottom of the step or ledge. The inside face 35 of the bight 30 preferably contacts the respective side face 25 or 26 of the core.

As illustrated in FIGS. 2 and 3, the metal members are affixed to the core by adjustable fastening means. These means may be screws 40 received in counter sunk openings 41 of the bight and legs 30, 29, or may be through-fasteners. A suitable through-fastener is shown on the left hand side of FIG. 2 where it consists of telescoping relatively threaded male and female members 45 each being headed and received in a counter sunk opening through the leg of the metal member. By threading together the male and female members, the adjustable fastener will maintain the legs in contact with the core.

Use of adjustable fasteners is desirable since during use of the device, application of force by means of a sledgehammer or the like in the direction of the arrow F can cause compaction or denting of the wood core in localized areas. Even when such compaction does not result in any permanent deformation due to the resilient nature of the wood core, it is necessary that relative movement, of sorts, be allowed between the rigid channel shaped metal members and the wood core since the resiliency of the wood core is highly desirable. Adjustable members allow for any relative displacement to be taken up at a later time.

Use of the U-shaped channel is desirable in that it adds both strength and warp resistence to the overall device 10.

In the preferred embodiment, the outside face 50 of at least one of the channel shaped metal members is coated with an anti-mar resilient surface. The surface coating 51 is preferably chosen such as to be bondable to the metal surface, to be durable thereon in the face of the heavy impact usage of the device, and to be resilient so as to protect the engaged side face of the plywood sheet 11 or other device being driven by the device 10. It is believed that vinyl copolymers will provide effective coatings having acceptable long life and resiliency. The depth of the coating 51 may be chosen in dependence on the resilient nature and other properties of the coating chosen but is, preferably, sufficiently great to provide a resilient cushion to the contacted side edge of the plywood sheet while at the same time allowing effective force transmittal.

It can therefore be seen from the above that my invention provides a driving tool member or work protector device to be interposed between a force applicator such as a sledgehammer or the like and a workpiece such as a plywood sheet. The device includes a central wood core and metal faced opposed sides, with at least one of the metal sides being coated with an anti-mar resilient coating. The metal facings are preferably U-shaped in cross-section having legs overlying the corners of the core and preferably received in stepped recesses. Adjustable fastening means are utilized to affix the metal channel members to the core.

Although the teachings of my invention have herein been discussed with reference to specific theories and embodiments, it is to be understood that these are by way of illustration only and that others may wish to utilize my invention in different designs or applications.

I claim as my invention:

1. A device for driving tongue and groove wood flooring members into seated position by application of hammer blows comprising a substantially rectangular cross-section wood core having a length which is a large multiple of the width thereof, each longitudinal corner thereof being stepped providing reduced ledges running longitudinally at all corners of the core, two U-shaped cross-section rigid metal channel members each having parallel spaced apart legs interconnected by a bight section, the legs being spaced apart by a distance substantially equal to the distance between spaced bottom surfaces of the stepped corners, the legs having a length substantially equal to the depth of the stepped corners, each of the channel members being carried by the wood core with the legs of each channel member being received in the stepped corners at one side of the core with the legs substantially filling the stepped corner, an inside face of the bight being in contact with the side face of the core, the legs lying substantially flush with the top and bottom faces of the core, fastening means securing the channel members to the core, an outside face of the bight of at least one member coated with a resilient antimar coating bonded thereto, the core being compressible under application of normal forces encountered in driving flooring members into seated engagement, the channel members being effective to prevent warpage of the core.

2. The device of claim 1 wherein the resilient antimar coating is vinyl.

3. The device of claim 1 wherein the means securing the channel members to the core are length adjustable and extend entirely through the wood core.

4. The device of claim 3 wherein means securing the channel member to the core extend both from the legs to the core and from the bight to the core.

* * * * *